US005474501A

United States Patent [19]

Teng

[11] Patent Number: 5,474,501

[45] Date of Patent: Dec. 12, 1995

[54] MAZE

[76] Inventor: Chung C. Teng, P.O. Box 2103, Taichung, Taiwan

[21] Appl. No.: 258,779

[22] Filed: Jun. 13, 1994

[51] Int. Cl.[6] ..... A63J 11/00

[52] U.S. Cl. ..... 472/62; 472/57; 52/726.3; 403/306; 403/311

[58] Field of Search ..... 472/62, 57; 403/305, 403/306, 309, 310, 311; 160/135, 351; 52/726.2, 726.3, 726.4

[56] References Cited

U.S. PATENT DOCUMENTS 4,143,985 3/1979 Axelsson et al. ..... 52/726.3 X 5,263,297 11/1993 Kim ..... 52/726.3 X

FOREIGN PATENT DOCUMENTS 35244 3/1993 Australia ..... 472/62

*Primary Examiner*—Kenneth J. Dorner
*Assistant Examiner*—Kien T. Nguyen

[57] ABSTRACT

A maze including a plurality of posts, a plurality of stretching members for inserting into longitudinal slots on the posts to reinforce the structural strength of the posts, a plurality of coupling members end matched between either two posts, and a plurality of partition members for connection horizontally between either two posts to define a network of intricate passages.

2 Claims, 5 Drawing Sheets

MAZE

BACKGROUND OF THE INVENTION

The present invention relates to a maze which is detachable and can be conveniently reorganized and, which needs less installation space.

Regular mazes are commonly not detachable, and therefore they cannot be adjusted to change the intricate passages when installed. Because regular mazes are not detachable, they are difficult to deliver. Still another drawback of regular mazes is that they are commonly arranged within a rectangular space and therefore they need much installation space. Furthermore, the height of regular mazes cannot be adjusted to fit players of different body sizes.

SUMMARY OF THE INVENTION

The present invention has been accomplished to provide a maze which eliminates the aforesaid drawbacks. It is therefore an object of the present invention to provide a built-up maze which needs less installation space. It is another object of the present invention to provide a maze which is detachable. It is still another object of the present invention to provide a maze which can be conveniently adjusted to change the height.

To achieve these objects, there is provided a maze comprised of:

a plurality of posts, each post comprising a center through hole through the longitudinal central axis, a plurality of first longitudinal slots and a plurality of second longitudinal slots alternatively spaced around said center through hole and longitudinally disposed through the length, a plurality of longitudinal gaps spaced around the periphery through the length and respectively disposed in communication with said second longitudinal slots, and pairs of locating holes respectively disposed inside the second longitudinal slots at two opposite ends;

a plurality of stretching members for inserting into the second longitudinal slots to reinforce the structural strength of the posts;

a plurality of coupling members for connection between either two posts longitudinally, each coupling member comprising a plurality of coupling portions symmetrically disposed at two opposite ends for respectively fitting into the center through hole and first longitudinal slots on either post, a plurality of longitudinal openings spaced around the periphery corresponding to the first longitudinal slots, and a plurality of retaining strips respectively disposed in the longitudinal openings, each retaining strip having a free end and a raised portion on the free end for fastening to either locating hole on either post; and a plurality of partition members for connection horizontally between either two posts, each partition member having two coupling portions at two opposite sides for inserting into either second longitudinal slot.

DETAILED DESCRIPTION OF THE PREFERRED EMBODIMENT

Figure 1:
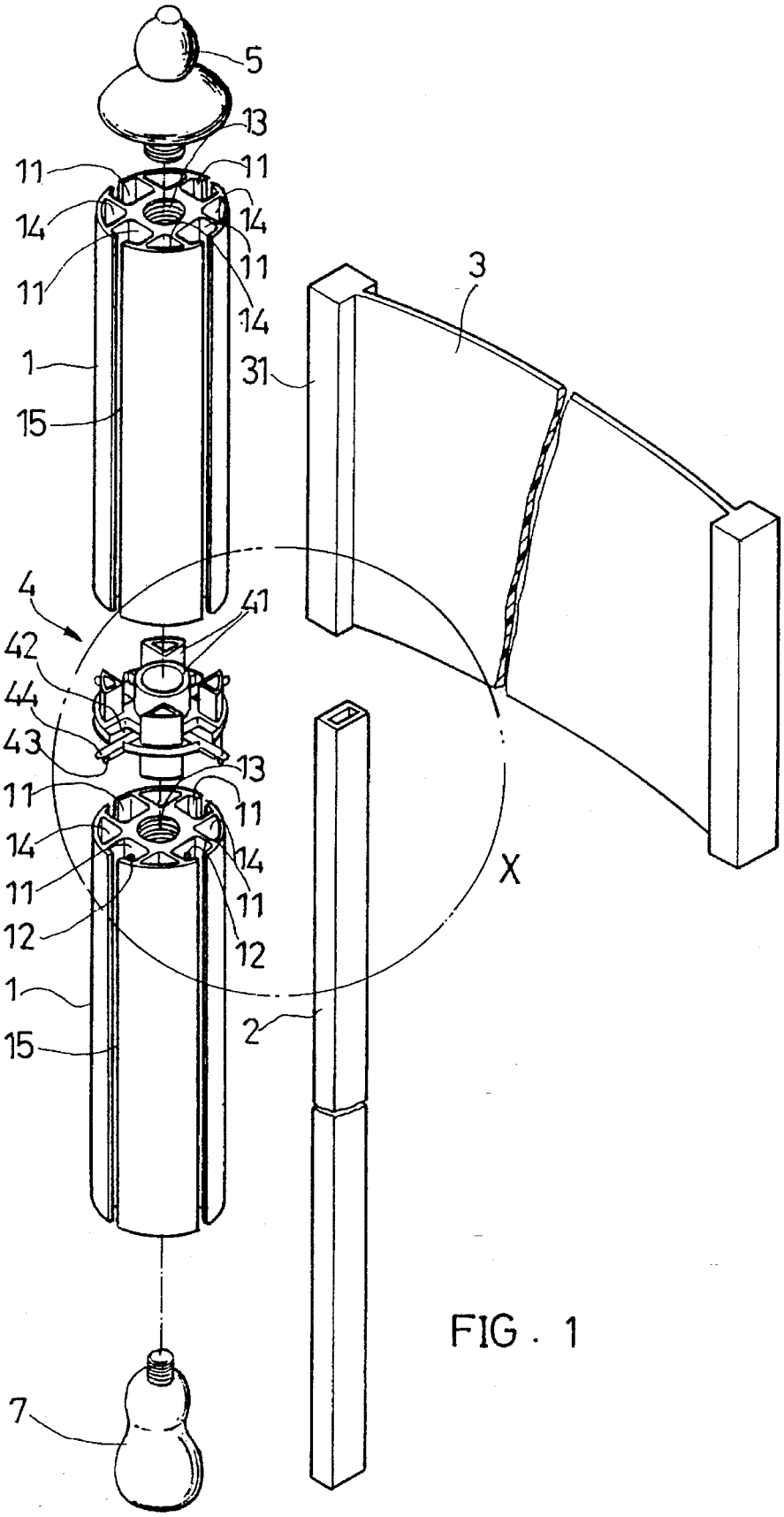
FIG. 1 is an exploded view of parts for a maze according to the present invention.
Figure 2:
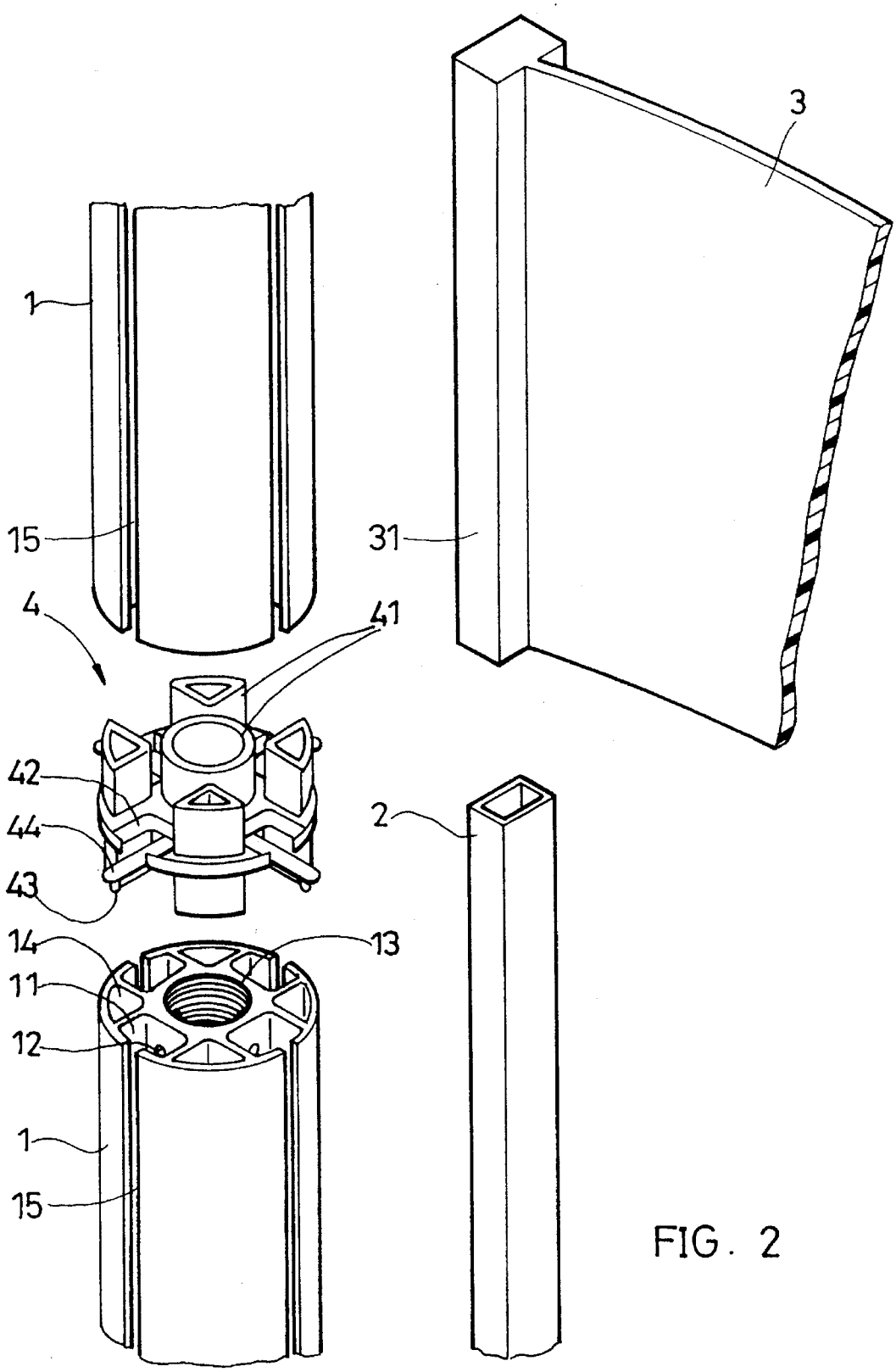
FIG. 2 is an enlarged view taken on part X of FIG. 1.

Referring to FIGS. 1 and 2, a maze according to the present invention is set up by connecting posts 1, stretching members 2, partition members 3, and coupling members 4 together.

The post 1 is a cylindrical rod having a center through hole 13 through the longitudinal central axis, a plurality of first longitudinal slots 14 and a plurality of second longitudinal slots 11 alternatively spaced around the center through hole 13 and longitudinally disposed through the length, a plurality of longitudinal gaps 15 spaced around the periphery through the length and respectively disposed in communication with the second longitudinal slots 11, and pairs of locating holes 12 respectively disposed inside the second longitudinal slots 11 at two opposite ends.

The stretching member 2 is made for sliding in either second longitudinal slot 11. The width of the stretching member 2 is shorter than that of the longitudinal gaps 15, therefore the stretching member 2 does not escape out of the second longitudinal slot 11 through the corresponding longitudinal gap 15 when inserted.

The partition member 3 is made in a flat shape having two coupling portions 31 at two opposite sides thereof. The size of the coupling portion 31 is approximately equal to the stretching member 2 so that it can be inserted into either second longitudinal slot 11 of either post 1. The thickness of the partition member 3 is thinner than the width of the gap 15 so that the partition member 3 can be extended out of the gap 15 when one coupling portion 31 of the partition member 3 is inserted into the second longitudinal slot 11.

The coupling member 4 is made fitting either end of each post 1, and therefore two posts 1 can be longitudinally connected together by the coupling member 4. The coupling member 4 comprises a plurality of coupling portions 41 symmetrically disposed at two opposite ends for respectively fitting into the center through hole 13 and first longitudinal slots 14 on either post 1, a plurality of longitudinal openings 42 spaced around the periphery corresponding to the first longitudinal slots 11, and a plurality of retaining strips 44 respectively disposed in the longitudinal openings 42 and having a respective raised portion 43 at the free end. The thickness of the retaining strip 44 is approximately equal to the gap left in the second longitudinal slot 11 after the insertion of the stretching member 2.

By fitting the coupling portions 41 into the center through hole 13 and the first longitudinal slots 14, a plurality of posts 1 can be vertically connected together to the desired height by a plurality of coupling members 4. When a plurality of posts 1 are connected together, a top cap 5 and a bottom stand 7 are respectively fastened to the connected series of posts 1 at two opposite ends.

Figure 3:
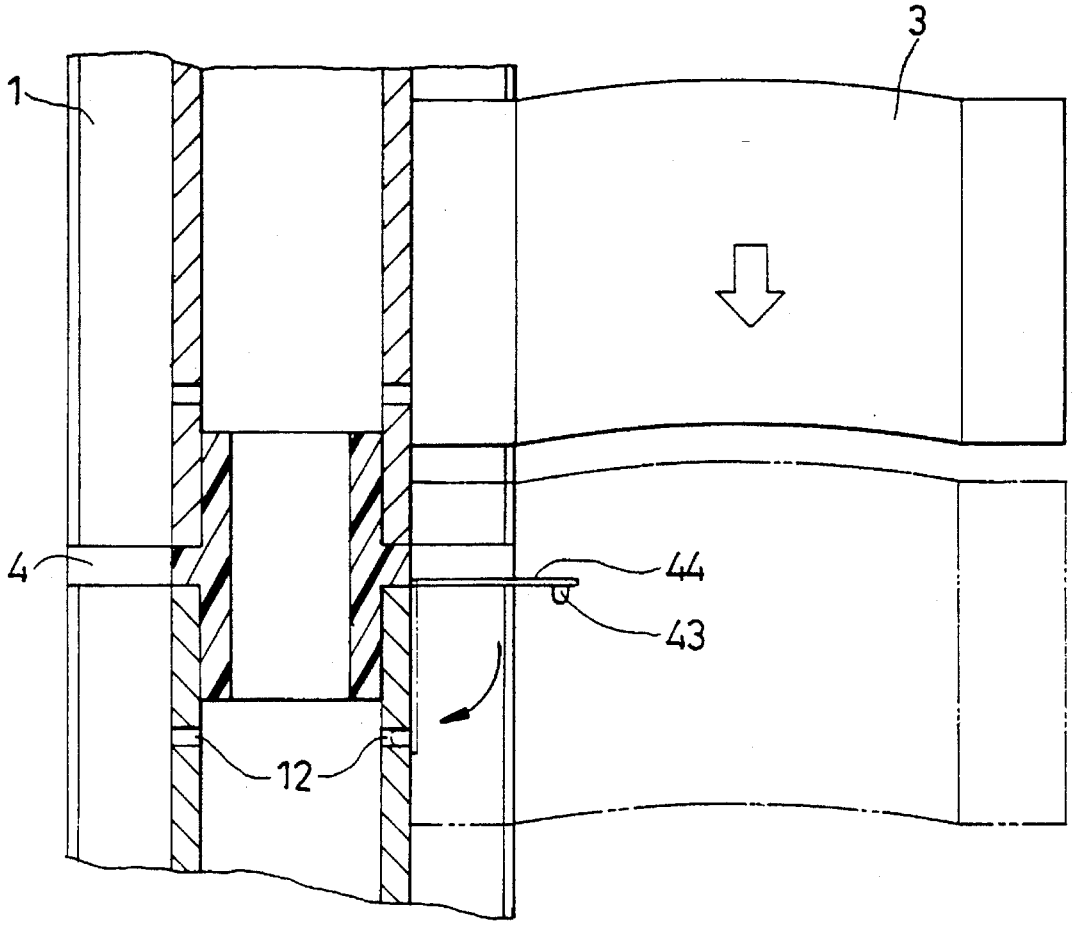
FIG. 3 is a sectional view showing the connection of a coupling member between two posts according to the present invention.

Referring to FIG. 3, when the stretching member 2 or either coupling portion 31 of the partition member 3 is inserted into two longitudinally aligned second longitudinal slots 11 of two longitudinally connected posts 1, it is allowed to pass through the corresponding longitudinal opening 42 on the matched coupling member 4. When assembled, the retaining strips 44 are respectively bent downwards inwards to engage the respective raised portions 43 into corresponding locating holes 12, and therefore the coupling member 4 and the post 1 are prohibited from longitudinal movement relative to each other.

Figure 4:
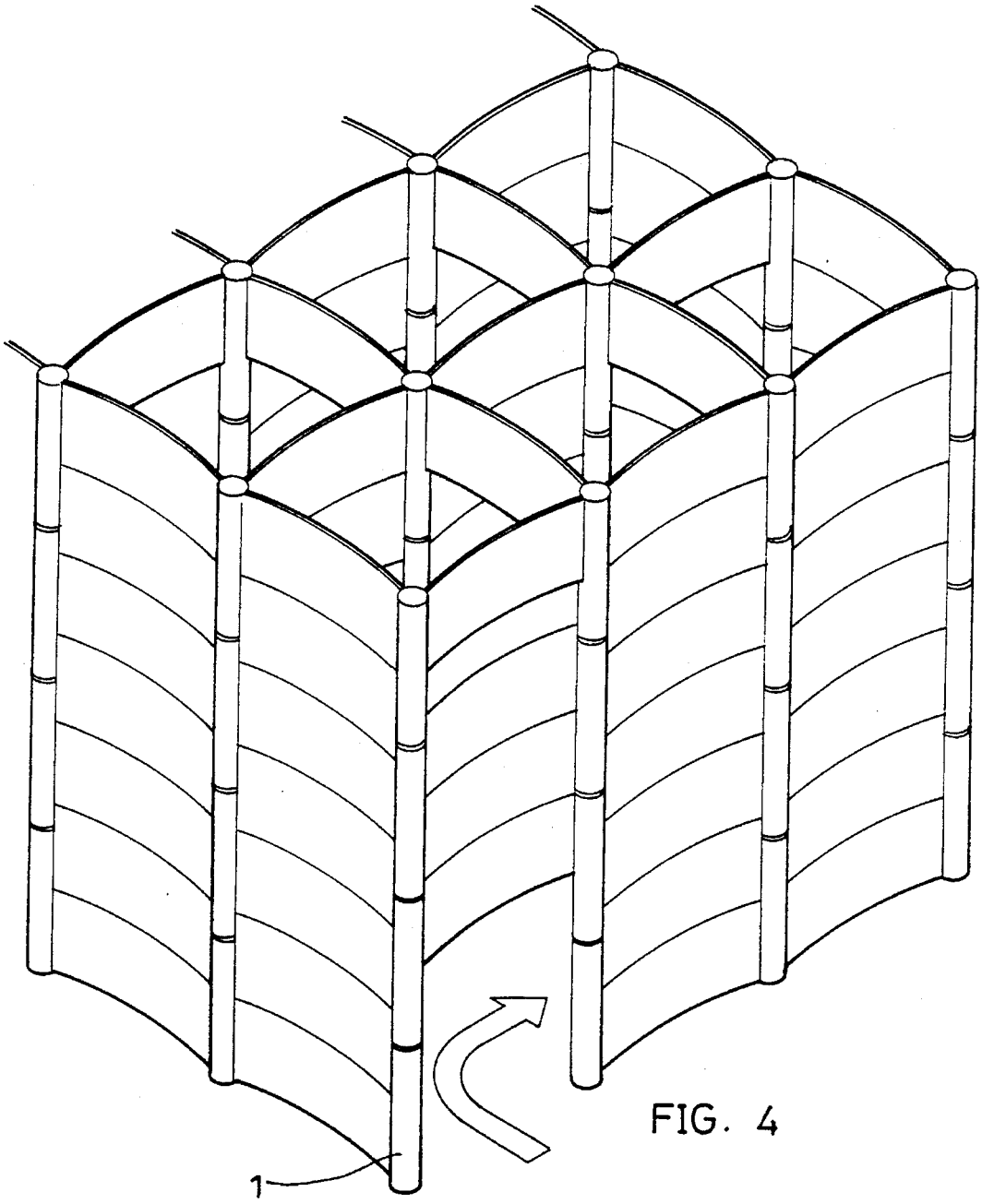
FIG. 4 shows a maze set up according to the present invention.
Figure 5:
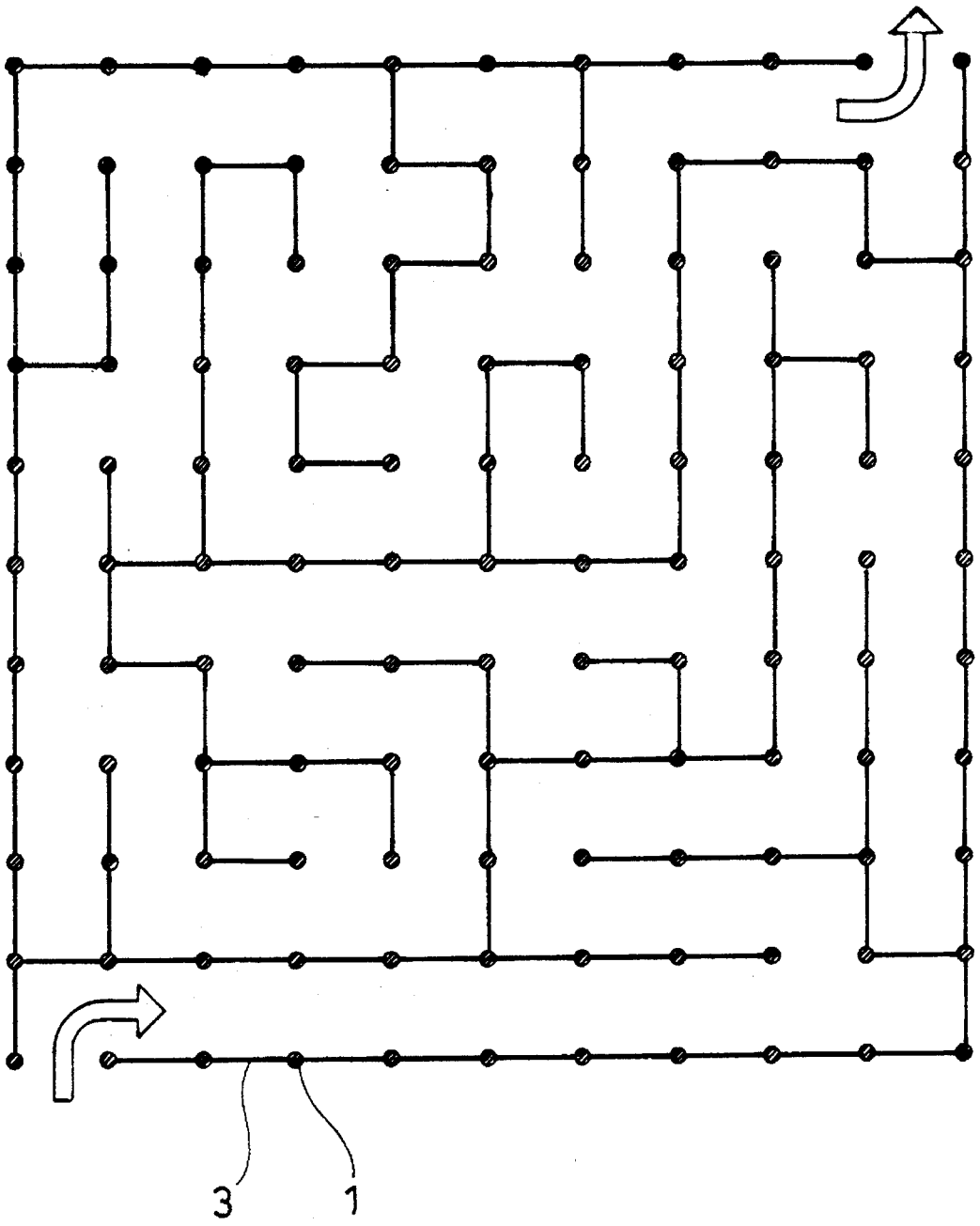
FIG. 5 is a transverse view in section of the maze shown in FIG. 4.

Referring to FIGS. 4 and 5, therein illustrated is a maze set up according to the present invention, which consists of 10×10 square blocks. By blocking up either one, two or three sides of each square block, a network of intricate passages is formed. Therefore, the user can design the desired network of intricate passages or change the design of the network of intricate passage.

The post 1 may be made from different materials. However, aluminum is most suitable for making the post 1 because it is rust proof and can be easily shape formed through an extruding process.

While only one embodiment of the present invention has been shown and described, it will be understood that various modifications and changes could be made without departing from the spirit and scope of the invention.

What is claimed is:

1. A maze comprising:

a plurality of posts, each post comprising a center through hole through the longitudinal central axis, a plurality of first longitudinal slots and a plurality of second longitudinal slots alternatively spaced around said center through hole and longitudinally disposed through the length, a plurality of longitudinal gaps spaced around the periphery through the length and respectively disposed in communication with said second longitudinal slots;

a plurality of stretching members for inserting into said second longitudinal slots to reinforce the structural strength of said posts;

a plurality of coupling members for connection between two posts longitudinally;

a plurality of partition members for connection horizontally between two posts, each partition member having two coupling portions at two opposite sides for inserting into said second longitudinal slot s of said two posts;

wherein:

each post further comprises pairs of locating holes respectively disposed inside said second longitudinal slots at two opposite ends;

each coupling member comprises a plurality of coupling portions symmetrically disposed at two opposite ends for respectively fitting into the center through hole and first longitudinal slots on said post, a plurality of longitudinal openings spaced around the periphery corresponding to said first longitudinal slots, and a plurality of retaining strips respectively disposed in said longitudinal openings, each retaining strip having a free end and a raised portion on said free end for fastening to said locating hole on either post.

2. The maze of claim 1 wherein said posts are extruded from aluminum.

* * * * *